US005367758A

United States Patent [19]

Morioka et al.

[11] Patent Number: 5,367,758

[45] Date of Patent: Nov. 29, 1994

[54] METHOD FOR MANUFACTURING SLIDE FASTENER COUPLING ELEMENTS

[75] Inventors: Koitsu Morioka; Yasuhiko Matsuda, both of Toyama, Japan

[73] Assignee: Yoshida Kogyo K.K., Tokyo, Japan

[21] Appl. No.: 81,103

[22] Filed: Jun. 25, 1993

[30] Foreign Application Priority Data

Jul. 6, 1992 [JP] Japan ..... 4-178287

[51] Int. Cl.[5] ..... B21D 53/52

[52] U.S. Cl. ..... 29/410; 29/33.2; 29/769

[58] Field of Search ..... 29/33.2, 33 K, 34 A, 29/408, 410, 766, 769

[56] References Cited

U.S. PATENT DOCUMENTS

| | | | |
|---|---|---|---|
| 2,125,707 | 8/1938 | Anderson et al. | 29/769 X |
| 2,294,253 | 8/1942 | Taberlet | 29/410 |
| 4,550,477 | 11/1985 | Iai | 29/33.2 |
| 4,974,305 | 12/1990 | Matsuda | 29/408 |
| 5,007,161 | 4/1991 | Matsuda | 29/769 |

FOREIGN PATENT DOCUMENTS

| | | |
|---|---|---|
| 0028358A2 | 10/1980 | European Pat. Off. . |
| 0048969A1 | 9/1981 | European Pat. Off. . |
| 2098889A | 12/1982 | United Kingdom . |

*Primary Examiner*—Z. R. Bilinsky

*Attorney, Agent, or Firm*—Hill, Steadman & Simpson

[57] ABSTRACT

A blank wire of a generally Y-shape cross section is supplied intermittently at a predetermined pitch, during which the blank wire is successively cut transversely into slices of a predetermined thickness. A bulge is formed at a time for a head portion of each of the successive coupling elements and the resulting individual coupling element is collected. Subsequently to the forming of the individual bulge, opposite leg portions of the individual coupling element are pre-clenched to such an extent as to prevent any crack from occurring in a possible surface-treated section of the coupling element when the opposite leg portions are clenched for attaching the coupling element to a slide fastener tape.

1 Claim, 5 Drawing Sheets

METHOD FOR MANUFACTURING SLIDE FASTENER COUPLING ELEMENTS

BACKGROUND OF THE INVENTION

1. Field of the Invention

This invention relates to a method of and an apparatus for successively forming slide fastener coupling elements by transversely cutting a blank wire of a generally Y-shape cross section with repeated rolling, and more particularly to a method of and an apparatus for forming coupling elements for slide fasteners suitable for use with quality products.

2. Description of the Related Art

Conventional slide fastener coupling element forming methods of the described type are chiefly divided into two groups: one in which generally Y-shape coupling elements are formed by successively punching a continuous length of flat belt-shape metal plate and, at the same time, bulges for successive coupling heads are formed one at a time (the resulting coupling elements will be hereinafter called "metal-plate coupling elements"); and the other in which individual coupling element blanks are obtained by threading a continuous length of blank wire through a plurality of rollers to shape it into a generally Y shape in cross section and then by successively cutting it into slices of a predetermined thickness using a coacting cutting punch and die, whereupon a bulge is formed at the individual coupling head of the coupling element using by a coacting bulge forming punch and die (the resulting coupling elements will be hereinafter called "wire coupling elements"). The former conventional method is exemplified by Japanese Utility Model Publication No. Sho 62-16886, and the latter conventional method is exemplified by Japanese Patent Publication No. Sho 59-27667. Subsequently, the coupling elements obtained by either conventional method are individually collected loose, or are successively attached to a fastener tape on the same apparatus.

In forming the coupling elements from a metal plate, though it is possible to freely design the coupling elements in a best shape required to be clenched on the fastener tape and in such a shape as not to obstruct the movement of a slider of the slide fastener, the rate of the non-punched-out section to the punched-out section would be fairly large for a desired shape, causing a large amount of loss of material more than the amount of products. Yet if this loss could be reduced to a minimum, it would be difficult to realize the best shape.

Further, since their cut surfaces appear on the surface of the products, the metal-plate coupling elements would make a poor show, depending on the sharpness of the press. Therefore, to obtain a quality product, the metal-plate coupling elements thus obtained are polished and then plated. Besides, since a bulge for the head portion of the coupling element is formed by the press simultaneously with cutting by the press, the bulge is apt to be misshaped to give a great influence on the sliding resistance of a slider.

In forming the coupling elements from a blank wire, since the wire coupling elements formed in a generally Y-shape cross section is successively cut into slices of a predetermined thickness perpendicularly to the blank wire, it is possible to achieve a very high rate of production with no loss of material. However, in order to avoid interference of rollers, since the Y cross-sectional shape and the distance of V leg portions in particular would be influenced resulting from the use of rollers when shaping the blank wire in a generally Y-shape cross section, it is impossible to secure an optimum Y-shape cross section. It is common knowledge that for various reasons described below, the distance between the V leg portions should preferably be minimum as long as the coupling element can be attached to the fastener tape. Nonetheless, since the inner surfaces of the leg portions are pressed by the rollers, the distance between the opposite leg portions cannot be set to less than the diameter of the roller.

Since either of the metal-plate coupling elements and the wire coupling elements are formed by punching, by pressing or by cutting, the resulting coupling elements would not have smooth cut surfaces and hence must be polished on such rough surfaces. In an effort to give a higher quality touch, the coupling elements should preferably be provided with surface treatment such as plating.

Assuming that the coupling elements attached to the fastener tape directly upon termination of forming process are to be provided with finishing treatment such as plating, it would be very difficult to realize such surface treatment to the coupling elements, which are mounted on the insulating fastener tape, in view of the increased cost of production as well as the complicated apparatus structure. Besides it is difficult to even polish the leg portions.

Conventionally, in order to give a higher quality touch, formed coupling elements are individually collected and are then provided with a surface treatment such as polishing or plating before being attached to the fastener tape. After this surface treatment, the coupling elements are conveyed to a fastener element mounting machine where the coupling elements are mounted successively on the inner longitudinal edge of the fastener tape at a predetermined pitch as the opposite leg portions of the individual coupling element are clenched on the inner longitudinal tape edge.

Therefore, for keeping the treated surfaces of the coupling elements free from cracks due to deformation of the leg portions when they are clenched, it should be preferable to set the initial distance of the opposite leg portions as small as possible. The metal-plate coupling elements are free of cracks since the initial distance of the opposite leg portions can be set freely; but, since alot of loss of material is inevitable when the coupling elements are punched out from the metal sheet, the metal-plate coupling elements would require an increased cost of production and would not be practical. On the other hand, the wire coupling elements are easy to manufacture and inexpensive; but, since the contour of the wire coupling elements is shaped by rolling, the initial distance of the opposite leg portions cannot be so small, which would make the coupling elements apt to be cracked.

SUMMARY OF THE INVENTION

It is, therefore, an object of the present invention to provide a slide fastener coupling element forming method and apparatus which prevents the opposite leg portions of the individual coupling element from cracks in surface when they are clenched on the inner longitudinal edge of a fastener tape after wire coupling elements, which is high in rate of production, have plated.

According to a first aspect of the invention, there is provided a method of successively forming slide fastener coupling elements by supplying a blank wire of a generally Y-shape cross section intermittently at a predetermined pitch, successively cutting the blank wire transversely into slices of a predetermined thickness, forming a bulge at a time for a head portion of each of the successive coupling elements and collecting the resulting individual coupling elements, wherein subsequently to the forming of the individual bulge, opposite leg portions of the individual coupling element are pre-clenched to such an extent as to prevent any crack from occurring in a possible surface-treated section of the coupling element when the opposite leg portions are clenched for attaching the coupling element to a slide fastener tape.

According to a second aspect of the invention, there is provided an apparatus for successively forming slide fastener coupling elements, comprising supplying means for supplying a blank wire of a generally Y-shape cross section intermittently at a predetermined pitch, a cutting die having a wire insertion hole for the passage of the blank wire and movable back and forth in a direction of cutting the blank wire, a bulge forming die connected with a forward end in the stroke direction of the cutting die for forming a bulge for a coupling head portion of the coupling element, a cutting punch fixedly mounted on a frame and slidable on an upper surface of the cutting die, a bulge forming punch situated upwardly of the bulge forming die and vertically movable toward and away from the bulge forming die, and means for discharging the freshly formed coupling elements individually, wherein the apparatus further includes means for pre-clenching opposite leg portions to such an extent as to prevent any crack from occurring in a possible surface-treated section of the coupling element when the opposite leg portions are clenched for attaching the coupling element to a slide fastener tape.

For example, as a first ram makes a forward stroke, a blank wire is conveyed longitudinally. At the end of the forward stroke of the first ram, the blank wire is stopped projecting from the cutting die by a predetermined length, i.e., a predetermined thickness of the coupling element. Then as the first ram makes a backward stroke, the projected portion of the blank wire is cut off by the cutting punch, and this predetermined length of the blank wire is then moved from the cutting die to the forming die. At that time, the pre-Clenching hammers support the leg portions of the individual coupling element from opposite sides. Next, at the end of the backward stroke of the first ram, the forming punch is lowered together with the pressure pad to form a bulge for a coupling head portion of the coupling element on the forming die. At that time, the pre-clenching hammers assume the inoperative position restricting the horizontal movement of the coupling element.

In that stage, the size of spread of the opposite leg portions L, L of the coupling element is relatively large as indicated by (i) in FIG. 8. Now, If the coupling elements are provided with a surface treatment, such as plating, and are then mounted on the fastener tape, the coupling element would be deformed by an increased amount as the opposite leg portions are clenched during mounting, the treated surface of the coupling element would be cracked or otherwise damaged, and additionally, the uniform clenching of the opposite leg portions L, L would be difficult to achieve, thus often causing an irregular arrangement of the coupling elements on the fastener tape.

In this invention, upon completion of forming a bulge on the head portion, the pre-clenching hammers are activated to clench the opposite leg portions so as to narrow the spread of the leg portions to a predetermined size as indicated by (ii) in FIG. 8. This pre-clenching terminates by the time the first ram reaches the front end of the stroke. At the front end of the stroke of the first ram, the pre-clenching hammer will return to its original position away from the opposite leg portions L, L of the coupling element E.

Finally, the formed coupling elements are discharged individually from the apparatus by a suitable means and are then collected, whereupon these coupling elements will be provided with a finishing treatment, such as plating. Then the resulting coupling elements will be forwarded to the coupling element mounting station wherein they are attached to the inner longitudinal edge of a non-illustrated fastener tape at a predetermined pitch by clenching the opposite leg portions in the usual method.

During that time, the amount of deformation of the coupling element by the clenching would be small as the spread of the opposite leg portions is previously narrowed to a predetermined size, and thus the treated surface of the coupling elements would be free from being cracked or otherwise damaged so that the coupling elements can be attached on the fastener tape uniformly.

DETAILED DESCRIPTION OF THE PRESENTLY PREFERRED EMBODIMENTS

A preferred embodiment of this invention will now be described in detail with reference to the accompanying drawings.

The most significant feature of this invention is that after the coupling element by cutting a blank wire of a generally Y-shape cross section is formed to have a bulge for a coupling head portion of the coupling element, the opposite leg portions are pre-clenched so as to have a predetermined size of spread so that the treated surface of the coupling element are prevented from being cracked when the coupling element is attached to the fastener tape by clenching the opposite leg portions.

The construction of this invention except the pre-clenching means may be of the ordinary type disclosed in, for example, Japanese Patent Publications Nos. Sho 59-42903 and Sho 59-51813. Therefore, the detailed description of the construction other than the pre-clenching means are omitted here for clarity, and the following description concentrates on the details of the pre-clenching means and includes only a brief explanation of the remaining construction.

Figure 1:
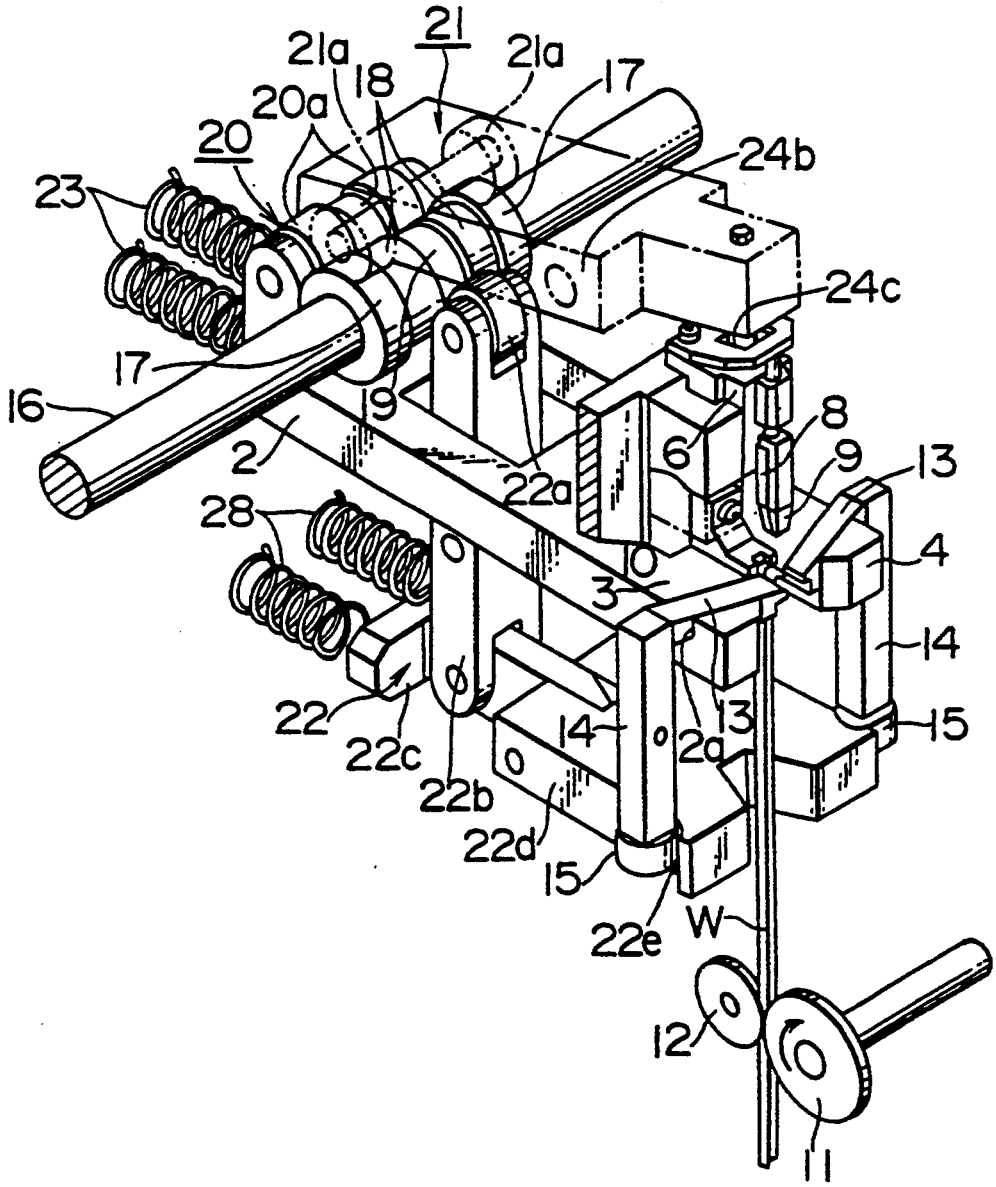
FIG. 1 is a fragmentary perspective view showing the main part of a coupling element forming apparatus according to a typical embodiment of this invention.
Figure 2:
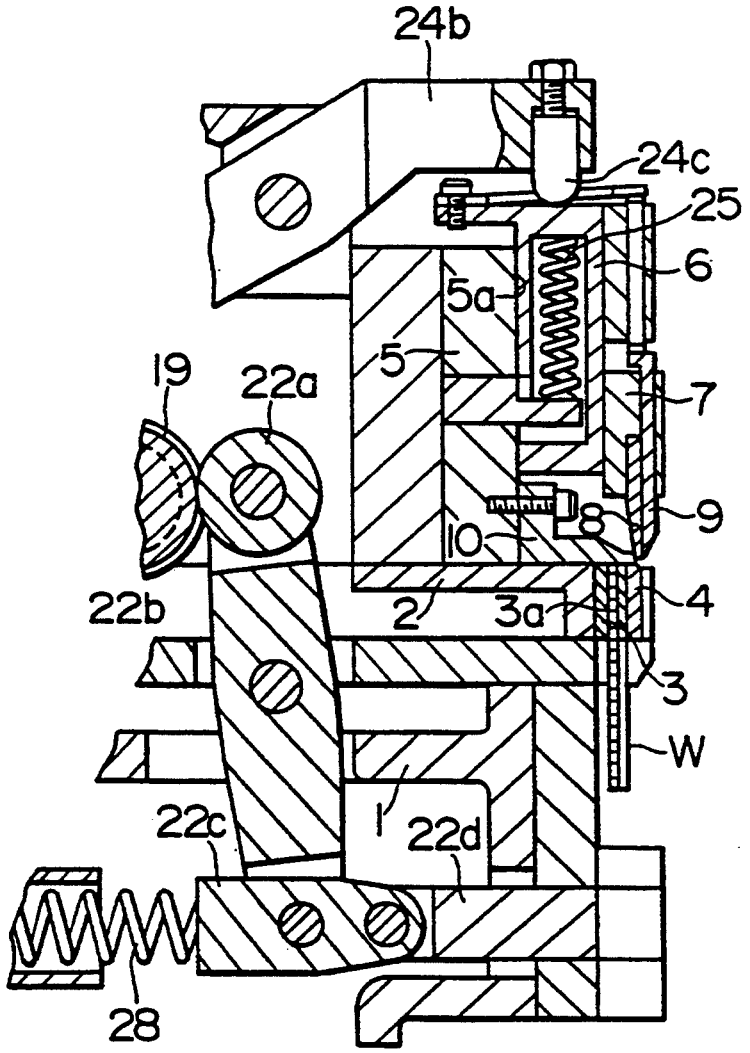
FIG. 2 is a vertical cross-sectional view showing the main part of the apparatus of FIG. 1.
Figure 3:
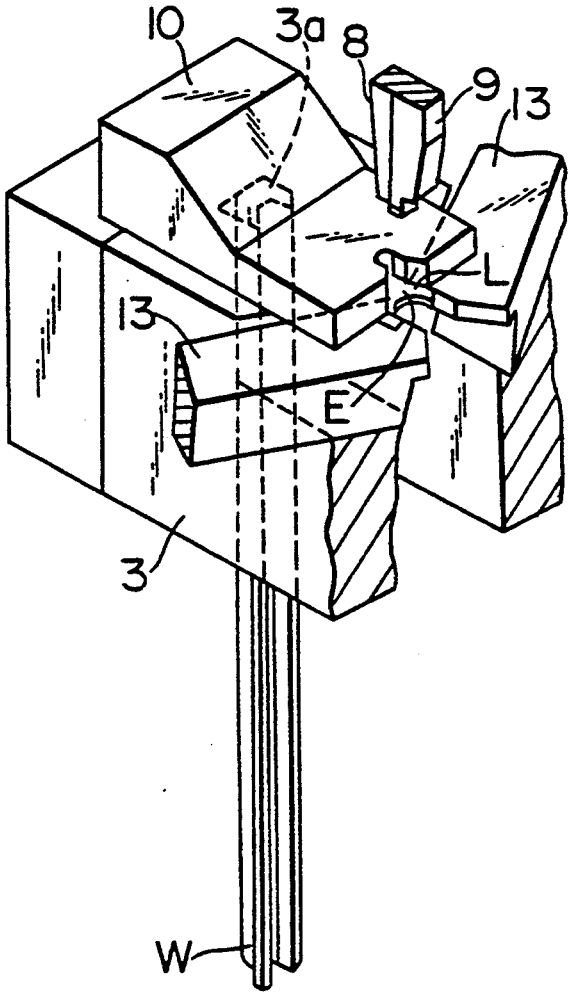
FIG. 3 is an enlarged, fragmentary cross-sectional view showing a coupling element forming unit, which constitutes the characterizing part of the invention.

FIGS. 1 through 3 show the main structure of a slide fastener coupling element forming apparatus embodying this invention. As shown in FIGS. 1 through 3, a first ram 2 is horizontally reciprocatingly movably mounted on a frame 1. A cutting die 3 is mounted on the forward end of the first ram 2, having a wire insertion hole 3*a* for the passage of a blank wire W having a Y-shape cross section. Connected to the first ram 2 contiguously to the cutting die 3 is a forming die 4 forming a bulge for a coupling head portion of the coupling element E.

A ram guide 5 is situated upwardly of the front part of the first ram 2 and has a guide groove 5*a* in which a second ram 6 is vertically movably received in timed relation with the horizontal reciprocating movement of the first ram 2. Attached to the front surface of the second ram 6 via a punch holder 7 are a forming punch 8 for forming a bulge for the head portion of the coupling element E and a pressure pad 9 for pressing the opposite leg portions of the coupling element E while the bulge is being formed. Further, a cutting punch 10 is fixed to the lower end of the ram guide 5 so as to frictionally contact the upper surface of the first ram 2. Downwardly of a wire insertion hole 3*a* of the cutting die 3, a feed roller 11 and a guide roller 12 are situated for intermittently supplying the blank wire W upwards at a pitch corresponding to the width of the coupling elemet E.

In this embodiment, a pair of pre-clenching hammers 13 are situated at opposite sides of the forming punch 8 and are slidably received in a hammer sliding groove 2*a* in the upper surface of the first ram 2 so as to be movable toward and away from each other. The pre-clenching hammers 13 force the leg portions of a coupling element inwardly from opposite sides to define a predetermined interleg space. The interleg space to be set up by this pre-clenching is such that no crack would occur on the treated surface of the individual coupling element E by clenching when the coupling element E is mounted on a fastener tape after provided with surface treatment such as plating.

The pre-clenching hammers 13 are attached to the upper end of an actuator lever 14 at a substantially right angle, there being a cam receiver 15 at the lower end of the actuator lever 14. The central portion of the actuator lever 14 is pivotally attached to the frame 1, and the actuator lever 14 is pivotally movable about the central portion in such a direction as to cross the first ram 2 at a predetermined angle, thus causing the pair of pre-clenching hammers 13 to slide toward and away from each other in the hammer sliding groove 2*a*.

The foregoing moving parts are actuated by a plurality of cams, such as a first-ram drive cam 18, a forming-punch actuation cam 18, a pre-clenching-hammer drive cam 19 and a non-illustrated wire supply cam, and a plurality of cam followers 20, 21, 22 connected to the respective cams. All of the cams are mounted on a drive output shaft 16 situated on the back side of the first ram 2.

In the cam follower mechanism 20 associated with the first ram 2, a roller 20*a* resting on the first-ram drive cam 18 pivotally mounted on the back part of the first ram 2 is normally urged forwardly by a compression spring 23. As the cam 18 moves angularly, the first ram 2 stops for a predetermined time at each of predetermined forward and backward ends of the stroke.

The cam follower mechanism 21 for the forming punch 8 includes a roller 21*a* resting on the forming-punch actuation cam 17, a lever 24*b* pivotally connected at one end to the roller 21*a* and at its central portion to the frame, a pin 24*c* attached to the other end of the lever 24*b* and contacting the head of the second ram 6, a non-illustrated compression spring for returning the lever 24*b* to its original position. Inside the second ram 6, there is mounted a compression spring 25 urging the second ram 6 upwardly; as the lever 24*b* is pivotally moved by the cam 18, the second ram 6 is lowered to return to its original position under the resilience of the compression spring 25.

The cam follower mechanism 22 for pre-clenching hammer 13 includes a roller 22*a* resting on the pre-clenching hammer drive cam 19, a downwardly extending lever 22*b* pivotally connected at one end to the roller 22*a* and at its central portion to the frame 1, a link 22*c* pivotally connected at its central portion to the other end of the lever 22*b*, a third ram 22*d* pivotally connected at its back portion to the front end portion of the link 22*c*, and the actuator lever 14 supporting on its upper portion a pre-clenching hammer 13 and pivotally connected at its central portion to the frame 1, and a compression spring 28 mounted on the back end of the link 22*c*. Both sides of front end portion of the third ram 22*d* have a pair of outwardly divergent cam surfaces 22*e*, with which the pair of cam receivers 15 formed on the lower ends of the actuator levers 14 is in contact. As the third ram 22*d* is moved backwardly, the cam receivers 15 contacting the cam surfaces 22*e* cause the actuator levers 14 to pivotally move to actuate the pre-clenching hammers 13. The third ram 22*d* returns to its original position under the resilience of the compression spring 28. By modifying the cam receivers 15 of the cam surfaces 22*e*, it is possible to change the actuation limit of the pre-clenching hammers 13.

A ratchet reciprocatingly driven by, for example, a non-illustrated cam causes the feed roller 11 via a non-illustrated ratchet wheel to intermittently angularly move only in one direction at a predtermined pitch, thus intermittently supplying the blank wire W in cooperation with the guide roller 12.

Figure 5A:
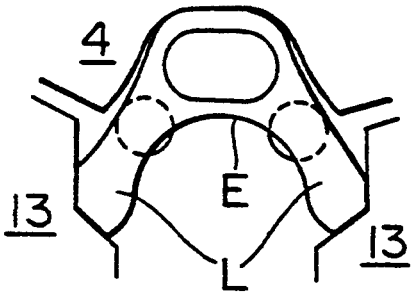
FIGS. 5(*a*) and 5(*b*) show the operation of the apparatus when forming a bulge for a head portion of the coupling element.
Figure 5B:
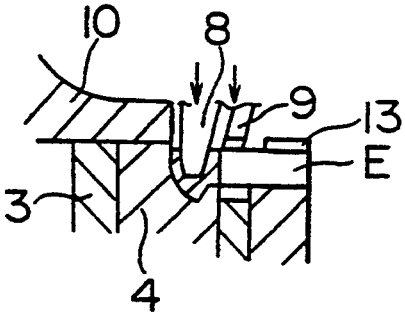
Figure 8:
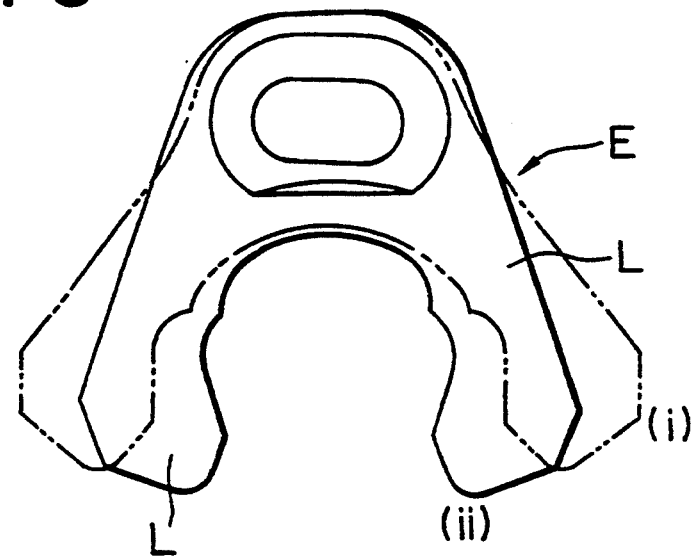
FIG. 8 is a plan view showing a contour of the coupling element in bulge forming and pre-clenching.

In this apparatus, while individual moving parts are actuated to perform the following operations in timed relation with one another, successive coupling elements are formed one after another. FIGS. 5(*a*), 5(*b*) through 7 show a series of steps of the coupling element forming method according to this invention, and FIG. 8 shows a contour of the coupling element in forming a bulge on the head portion and pre-clenching.

Figure 4A:
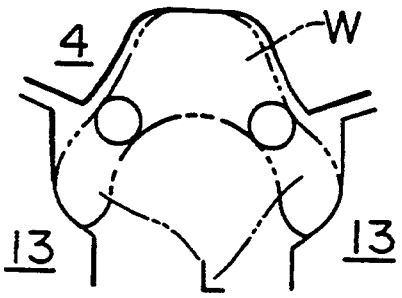
FIGS. 4(*a*) and 4(*b*) show the operation and position of the apparatus when cutting a blank wire.
Figure 4B:
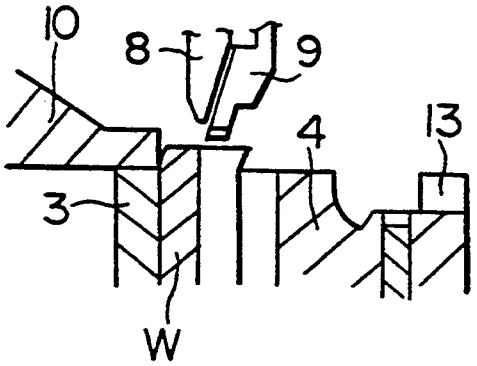

In FIG. 4(*a*), the cut coupling element E is not yet received in the mold of the forming die 4, and the pre-clenching hammers 13 stops in the original position. In FIG. 4(*b*), the first ram 2 starts moving backwardly, and the projected part of the blank wire W is cut off by the cutting punch 10, whereupon at the end of backward stroke of the first ram 2, the coupling element E is moved from the cutting die 3 into the mold of the forming die 4 in the position of FIG. 4(*a*). When no coupling element E is set on the forming die 4 as shown in FIG. 4(*a*), the pre-clenching hammers 13 are situated at such a position as to substantially contact the outer surfaces of the opposite leg portions L, L of the coupling element E.

In FIG. 4(*b*), at the end of the forward stroke of the first ram 2, the supply of the blank wire W has been terminated, projecting from the upper surface of the cutting die 3 by a predetermined extent, which projected portion is about to be cut off. In other words, the first ram 2 starts moving backwardly to cut off the projected portion of the blank wire W by the cutting punch 10, and at the end of its backward stroke, the first ram 2 moves the cut coupling element blank from the cutting die 3 to the forming die 4.

Next, at the end of backward stroke of the first ram 2, as shown in FIG. 5(*b*), the forming punch 8 with the pressure pad 9 is lowered to form a bulge for the coupling head portion. At that time, the pre-clenching hammer 13 is stopped to restrict the horizontal movement of the coupling element E. In that stage, the size of spread of the opposite leg portions L, L of the coupling element is relatively large as indicated by (i) in FIG. 8. Now, If the coupling elements are provided with a surface treatment such as plating and are then mounted on the fastener tape, the coupling element would be deformed by an increased amount as the opposite leg portions are clenched during mounting, the treated surface of the coupling element would be cracked or otherwise damaged, and additionally, the uniform clenching of the opposite leg portions L, L would be difficult to achieve, thus often causing an irregular arrangement of the coupling elements on the fastener tape.

Figure 6:
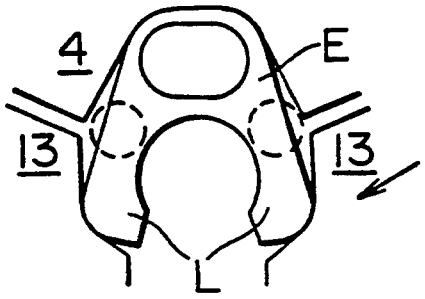
FIG. 6 shows the operation of the apparatus when pre-clenching opposite leg portions of the coupling element by a hammer.
Figure 7:
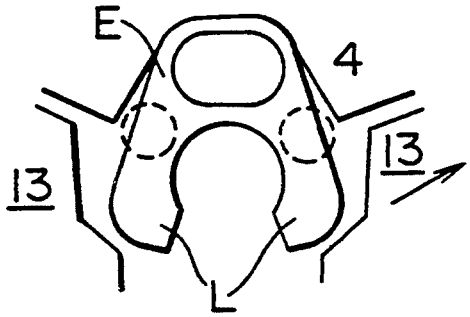
FIG. 7 shows the operation of the apparatus when releasing the pre-clenching.

In this invention, upon completion of forming a bulge on the coupling head portion, the pre-clenching hammers 13 are activated to clench the opposite leg portions, as shown in FIG. 6, so as to narrow the spread of the leg portions to a predetermined size as indicated by (ii) in FIG. 8. This pre-clenching terminates by the time the first ram reaches the forward end of the stroke. At the end of the forward stroke of the first ram, the pre-clenching hammer will return to its original position away from the opposite leg portions L, L of the coupling element E as shown in FIG. 7.

Finally, the formed coupling elements are discharged individually from the apparatus by a suitable means and are then collected, whereupon these coupling elements will be provided with a finishing treatment such as plating. Then the resulting coupling elements will be forwarded to the coupling element mounting station wherein they are attached to the inner longitudinal edge of a non-illustrated fastener tape at a predetermined pitch by clenching the opposite leg portions in the usual method.

During that time, the amount of deformation of the coupling element by the clenching would be small as the spread of the opposite leg portions is previously narrowed to a predetermined size, and the treated surface of the coupling elements would be free from being cracked or otherwise damaged so that the coupling elements can be attached on the fastener tape uniformly.

As is apparent from the foregoing description, according to this invention, the blank wire shaped into a generally Y-shape cross section by rolling is cut into slices having a predetermined thickness one at a time and a bulge is formed on the prospective head portion of the individual coupling element blank by pressing, whereupon the opposite leg portions are pre-clenched from opposite sides to reduce the spread to a predetermined size. The result is that since the coupling elements surface-treated in the subsequent process would be less deformed when clenched during the mounting of the coupling element, the treated surface of the coupling element would be free from being cracked or otherwise damaged, thus realizing a very neatly arranged row of coupling elements on the fastener tape.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A method of successively forming slide fastener coupling elements, the method comprising the steps of:

supplying a blank wire of a generally Y-shape cross section intermittently at a predetermined pitch;

successively cutting the blank wire transversely into slices of a predetermined thickness;

forming a bulge for a head portion of each of the successive coupling elements preclenching opposite leg portions of the coupling element to prevent any crack from occurring in a possible surface-treated section of the coupling element when the opposite leg portions are clenched; and collecting the resulting individual coupling elements for attaching the coupling element to a slide fastener tape.

* * * * *